US011854479B2

(12) United States Patent
Ouyang et al.

(10) Patent No.: US 11,854,479 B2
(45) Date of Patent: Dec. 26, 2023

(54) DISPLAY APPARATUS AND METHOD FOR CONTROLLING DISPLAY APPARATUS

(71) Applicant: Huawei Technologies Co., Ltd., Shenzhen (CN)

(72) Inventors: Shiangruei Ouyang, Shenzhen (CN); Haiming He, Shenzhen (CN)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 0 days.

(21) Appl. No.: 17/800,976

(22) PCT Filed: Jan. 8, 2021

(86) PCT No.: PCT/CN2021/070877
§ 371 (c)(1),
(2) Date: Aug. 19, 2022

(87) PCT Pub. No.: WO2021/164456
PCT Pub. Date: Aug. 26, 2021

(65) Prior Publication Data

US 2023/0063341 A1 Mar. 2, 2023

(30) Foreign Application Priority Data

Feb. 21, 2020 (CN) ..... 202010106550.7

(51) Int. Cl.
*G09G 3/3233* (2016.01)

(52) U.S. Cl.
CPC ... *G09G 3/3233* (2013.01); *G09G 2300/0842* (2013.01); *G09G 2310/08* (2013.01);
(Continued)

(58) Field of Classification Search
CPC ..... G09G 3/3233; G09G 2300/0842; G09G 2310/08; G09G 2320/0233;
(Continued)

(56) References Cited

U.S. PATENT DOCUMENTS 10,276,100 B2 * 4/2019 Huangfu ..... G09G 3/3233
10,782,810 B2 * 9/2020 Park ..... G06F 3/04164
(Continued)

FOREIGN PATENT DOCUMENTS

CN 104658484 A 5/2015
CN 105427811 A 3/2016
(Continued)

*Primary Examiner* — Doon Y Chow
(74) *Attorney, Agent, or Firm* — Conley Rose, P.C.

(57) ABSTRACT

A display apparatus including a plurality of pixel circuit rows, where each pixel circuit row includes a plurality of pixel circuits, and each pixel circuit includes a light emitting component and a driving circuit. A gate voltage generation circuit generates a plurality of scan signals. A first scan signal and a second scan signal respectively control write circuits in driving circuits in a first pixel circuit row and a second pixel circuit row. The write circuit adjusts, based on a data voltage for controlling luminance of a light emitting component, a voltage at one end of a storage capacitor to a first voltage. The first scan signal further controls a reset circuit in a driving circuit in a second pixel circuit row, and the reset circuit resets the voltage at one end of the storage capacitor to a second voltage based on a reference voltage.

20 Claims, 6 Drawing Sheets

(52) U.S. Cl.
CPC ..... *G09G 2320/0233* (2013.01); *G09G 2320/0626* (2013.01); *G09G 2330/021* (2013.01); *G09G 2330/028* (2013.01)

(58) Field of Classification Search
CPC ..... G09G 2320/0626; G09G 2330/021; G09G 2330/028
See application file for complete search history.

(56) References Cited

U.S. PATENT DOCUMENTS

| | | | | |
|---|---|---|---|---|
| 10,789,891 | B2 * | 9/2020 | Feng | G09G 3/3233 |
| 10,923,033 | B2 * | 2/2021 | Wang | G09G 3/3258 |
| 10,950,157 | B1 * | 3/2021 | Kim | G09G 3/20 |
| 11,158,226 | B2 * | 10/2021 | Feng | G09G 3/20 |
| 11,211,014 | B2 * | 12/2021 | Han | G09G 3/3233 |
| 2012/0038605 | A1 | 2/2012 | Han et al. | |
| 2012/0147060 | A1 | 6/2012 | Jeong | |
| 2014/0333513 | A1 | 11/2014 | Park et al. | |
| 2015/0243210 | A1 | 8/2015 | Park et al. | |
| 2016/0275854 | A1 | 9/2016 | Wang | |
| 2016/0321990 | A1 | 11/2016 | Kim et al. | |
| 2017/0221420 | A1 | 8/2017 | Zhu | |
| 2017/0256205 | A1 | 9/2017 | Zhu | |
| 2017/0365218 | A1 | 12/2017 | Jeong et al. | |
| 2018/0240400 | A1 | 8/2018 | Zhou et al. | |
| 2019/0005877 | A1 * | 1/2019 | Dong | G09G 3/3266 |
| 2019/0066604 | A1 | 2/2019 | Kong | |
| 2019/0088200 | A1 | 3/2019 | Woo et al. | |
| 2019/0348491 | A1 | 11/2019 | Chung et al. | |
| 2019/0355302 | A1 * | 11/2019 | Ding | G09G 3/3275 |
| 2019/0362670 | A1 * | 11/2019 | Liu | G09G 3/3233 |
| 2021/0201761 | A1 | 7/2021 | Yin | |

FOREIGN PATENT DOCUMENTS

| | | | |
|---|---|---|---|
| CN | 106652912 | A | 5/2017 |
| CN | 106782330 | A | 5/2017 |
| CN | 107154239 | A | 9/2017 |
| CN | 107680537 | A | 2/2018 |
| CN | 109427285 | A | 3/2019 |
| CN | 110062943 | A | 7/2019 |
| JP | 2012037857 | A | 2/2012 |
| JP | 2019197723 | A | 11/2019 |
| KR | 20110122410 | A | 11/2011 |

* cited by examiner

DISPLAY APPARATUS AND METHOD FOR CONTROLLING DISPLAY APPARATUS

CROSS-REFERENCE TO RELATED APPLICATIONS

This is a U.S. National Stage of International Patent Application No. PCT/CN2021/070877 filed on Jan. 8, 2021, which claims priority to Chinese Patent Application No. 202010106550.7 filed on Feb. 21, 2020. Both of the aforementioned applications are hereby incorporated by reference in their entireties.

TECHNICAL FIELD

One or more embodiments of this application usually relate to the liquid crystal display field, and in particular, to a display apparatus and a method for controlling a display apparatus.

BACKGROUND

Organic light-emitting diode (organic light emitting diode, OLED) displays are widely used due to advantages such as wide vision, good color contrast, a high response speed, and low costs. In an OLED array of an OLED display, each OLED has a corresponding driving circuit, and the driving circuit is usually constructed by a plurality of thin film transistors (thin film transistor, TFT), However, TFTs of different driving circuits have non-uniformity in electrical parameters such as a threshold voltage (to be specific, a bias voltage that is between a gate electrode and a source electrode and that enables the TFT to be in a critical cut-off state or a critical conducting state) and mobility. This causes a difference in luminance of light emitted by different OLEDs, and the difference is sensed by human eyes. This phenomenon is referred to as a mura (mura) phenomenon, and the mura phenomenon reduces display performance of the display apparatus.

In the conventional technology, to resolve a display luminance mura phenomenon caused by different threshold voltages of TFTs of different driving circuits, a driving circuit that has a compensation function is usually constructed, such as a 6T1C, 7T1C, or 8T1C driving circuit, and driving of an OLED includes three phases: resetting, writing, and light emitting driving. When a frame scanning frequency is relatively high, a write phase is relatively short, and impact of the threshold voltage of the TFTs on a drive current passing through the OLED cannot be eliminated. Consequently, the mura phenomenon cannot be eliminated.

SUMMARY

The following describes this application from a plurality of aspects. For implementations and beneficial effects of the following plurality of aspects, reference may be made to each other.

A first aspect of this application provides a display apparatus, and the display apparatus includes:

- a plurality of pixel circuit rows, where each of the plurality of pixel circuit rows includes a plurality of pixel circuits, and each of the plurality of pixel circuits includes a light emitting component and a driving circuit that drives the light emitting component; and
- a gate voltage generation circuit, configured to generate a plurality of scan signals.

A first scan signal and a second scan signal in the plurality of scan signals are respectively used to control write circuits in driving circuits in a first pixel circuit row and a second pixel circuit row in the plurality of pixel circuit rows, the write circuit is configured to adjust a voltage at one end of a storage capacitor in the driving circuit to a first voltage based on a data voltage, and the data voltage is used to control luminance of light emitted by the light emitting component.

The first scan signal is further used to control a reset circuit in the driving circuit in the second pixel circuit row, and the reset circuit is configured to reset the voltage at the one end of the storage capacitor to a second voltage based on a reference voltage.

In a same frame scan cycle, a moment at which the first scan signal starts to be loaded to the first pixel circuit row is earlier than a moment at which the first scan signal and the second scan signal start to be loaded to the second pixel circuit row by an odd multiple of a clock cycle, where the odd multiple is greater than or equal to 3. The first scan signal and the second scan signal start to be loaded to the second pixel circuit row at the same time. The first scan signal is loaded to the write circuit in the driving circuit in the first pixel circuit row, and is also loaded to the reset circuit in the driving circuit in the second pixel circuit row. The second scan signal is loaded to the write circuit in the driving circuit in the second pixel circuit row.

In this embodiment of this application, the scan signal of the second pixel circuit row and the scan signal of the first pixel circuit row are loaded to the second pixel circuit row by using the gate voltage generation circuit. A row scan time of the first pixel circuit row is earlier than a row scan time of the second pixel circuit row by an odd multiple (greater than or equal to 3) of a clock cycle, so that a quantity of valid write phases can be increased for pixel circuits in the second pixel circuit row. This can ensure that a luminance mura phenomenon of light emitted by light emitting components due to different threshold voltages of transistors in different driving circuits can be eliminated.

In some embodiments, in a time period in which the first scan signal and the second scan signal are loaded in the second pixel circuit, a moment of an initial low electrical level of the first scan signal is earlier than a moment of an initial low electrical level of the second scan signal by an odd multiple of a clock cycle, where the odd multiple is greater than or equal to 3.

In some embodiments, in a time period in which the first scan signal and the second scan signal are loaded in the second pixel circuit, a moment of an initial high electrical level of the first scan signal is earlier than a moment of an initial high electrical level of the second scan signal by an odd multiple of a clock cycle, where the odd multiple is greater than or equal to 3.

In some embodiments, the driving circuit includes seven transistors and one storage capacitor.

In some embodiments, the write circuit includes:

- a first transistor, where a gate voltage of the first transistor is controlled by the first scan signal or the second scan signal, and a source voltage of the first transistor is controlled by the data voltage;
- a second transistor, where a source electrode of the second transistor is coupled to a drain electrode of the first transistor, and a gate electrode of the second transistor is coupled to one end of the storage capacitor; and
- a third transistor, where a gate voltage of the third transistor is controlled by the first scan signal or the second scan signal, a drain electrode of the third transistor is coupled to the gate electrode of the second transistor and the one end of the storage capacitor, and a source electrode of the third transistor is coupled to a drain electrode of the second transistor.

In some embodiments, the reset circuit includes:

a fourth transistor, where a gate electrode of the fourth transistor is controlled by the first scan signal, a source electrode of the fourth transistor is controlled by the reference voltage, and a drain voltage of the fourth transistor is coupled to the one end of the storage capacitor.

In some embodiments, the first voltage is equal to a sum of a threshold voltage of the second transistor and a difference between the data voltage and a voltage between a source electrode and the drain electrode of the first transistor.

In this embodiment of this application, the first voltage is equal to the sum of the threshold voltage of the second transistor and the difference between the data voltage and the voltage between the source electrode and the drain electrode of the first transistor. This can ensure that impact of the threshold voltage of the second transistor on the luminance of light emitted by light emitting components can be eliminated in a light emitting driving phase.

In some embodiments, the second voltage is equal to a difference between the reference voltage and a voltage between the source and a drain of a fifth transistor.

In some embodiments, the light emitting component includes at least one of an OLED and an LED, and a self capacitor connected in parallel to the at least one of the OLED and the LED.

A second aspect of this application provides a method for controlling a display apparatus. The display apparatus includes a of pixel circuit rows, each of the plurality of pixel circuit rows includes a plurality of pixel circuits, each of the plurality of pixel circuits includes a light emitting component and a driving circuit that drives the light emitting component, and the method includes:

generating a plurality of scan signals;

respectively loading a first scan signal and a second scan signal in the plurality of scan signals to write circuits in driving circuits in a first pixel circuit row and a second pixel circuit row in the plurality of pixel circuit rows, where the write circuit is configured to adjust a voltage at one end of a storage capacitor in the driving circuit to a first voltage based on a data voltage, and the data voltage is used to control luminance of light emitted by the light emitting component; and loading the first scan signal to a reset circuit in the driving circuit in the second pixel circuit row, where the reset circuit is configured to reset the voltage at the one end of the storage capacitor to a second voltage based on a reference voltage.

In a same frame scan cycle, a moment at which the first scan signal starts to be loaded to the first pixel circuit row is earlier than a moment at which the first scan signal and the second scan signal start be loaded to the second pixel circuit row by an odd multiple of a clock cycle, where the odd multiple is greater than or equal to 3. The first scan signal and the second scan signal start to be loaded to the second pixel circuit row at the same time. The first scan signal is loaded to the write circuit in the driving circuit in the first pixel circuit row, and is also loaded to the reset circuit in the driving circuit in the second pixel circuit row. The second scan signal is loaded to the write circuit in the driving circuit in the second pixel circuit row.

In this embodiment of this application, the scan signal of the second pixel circuit row and the scan signal of the first pixel circuit row are loaded to the second pixel circuit row by using a gate voltage generation circuit. A row scan time of the first pixel circuit row is earlier than a row scan time of the second pixel circuit row by an odd multiple (greater than or equal to 3) of a clock cycle, so that a quantity of valid write phases can be increased for pixel circuits in the second pixel circuit row. This can ensure that a luminance mura phenomenon of light emitted by light emitting components due to different threshold voltages of transistors in different driving circuits can be eliminated.

In some embodiments, in a time period in which the first scan signal and the second scan signal are loaded in the second pixel circuit, a moment of an initial low electrical level of the first scan signal is earlier than a moment of an initial low electrical level of the second scan signal by an odd multiple of a clock cycle, where the odd multiple is greater than or equal to 3.

In some embodiments, in a time period in which the first scan signal and the second scan signal are loaded in the second pixel circuit, a moment of an initial high electrical level of the first scan signal is earlier than a moment of an initial high electrical level of the second scan signal by an odd multiple of a clock cycle, where the odd multiple is greater than or equal to 3.

In some embodiments, the driving circuit includes seven transistors and one storage capacitor.

In some embodiments, the write circuit includes:

a first transistor, where a gate voltage of the first transistor is controlled by the first scan signal or the second scan signal, and a source voltage of the first transistor is controlled by the data voltage;

a second transistor, where a source electrode of the second transistor is coupled to a drain electrode of the first transistor, and a gate electrode of the second transistor is coupled to one end of the storage capacitor; and a third transistor, where a gate voltage of the third transistor is controlled by the first scan signal or the second scan signal, a drain electrode of the third transistor is coupled to the gate electrode of the second transistor and the one end of the storage capacitor, and a source electrode of the third transistor is coupled to a drain electrode of the second transistor.

In some embodiments, the reset circuit includes:

a fourth transistor, where a gate electrode of the fourth transistor is controlled by the first scan signal, a source electrode of the fourth transistor is controlled by the reference voltage, and a drain voltage of the fourth transistor is coupled to the one end of the storage capacitor.

In some embodiments, the first voltage is equal to a sum of a threshold voltage of the second transistor and a difference between the data voltage and a voltage between a source electrode and the drain electrode of the first transistor.

In this embodiment of this application, the first voltage is equal to the sum of the threshold voltage of the second transistor and the difference between the data voltage and the voltage between the source electrode and the drain electrode of the first transistor. This can ensure that impact of the threshold voltage of the second transistor on the luminance of light emitted by light emitting components can be eliminated in the light emitting driving phase.

In some embodiments, the second voltage is equal to a difference between the reference voltage and a voltage between the source and a drain of a fifth transistor.

In some embodiments, the light emitting component includes at least one of an OLED and an LED, and a self-capacitor connected in parallel to the at least one of the OLED and the LED.

DESCRIPTION OF EMBODIMENTS

The following describes the technical solutions in embodiments of this application with reference to the accompanying drawings in embodiments of this application. In description in embodiments of this application, "/" means "or" unless otherwise specified. For example, A/B may represent A or B. In this specification, "and/or" describes only an association relationship for describing associated objects and represents that three relationships may exist. For example, A and/or B may represent the following three cases: Only A exists, both A and B exist, and only B exists. In addition, in the descriptions in embodiments of this application, "a plurality of" means two or more than two.

Figure 1:
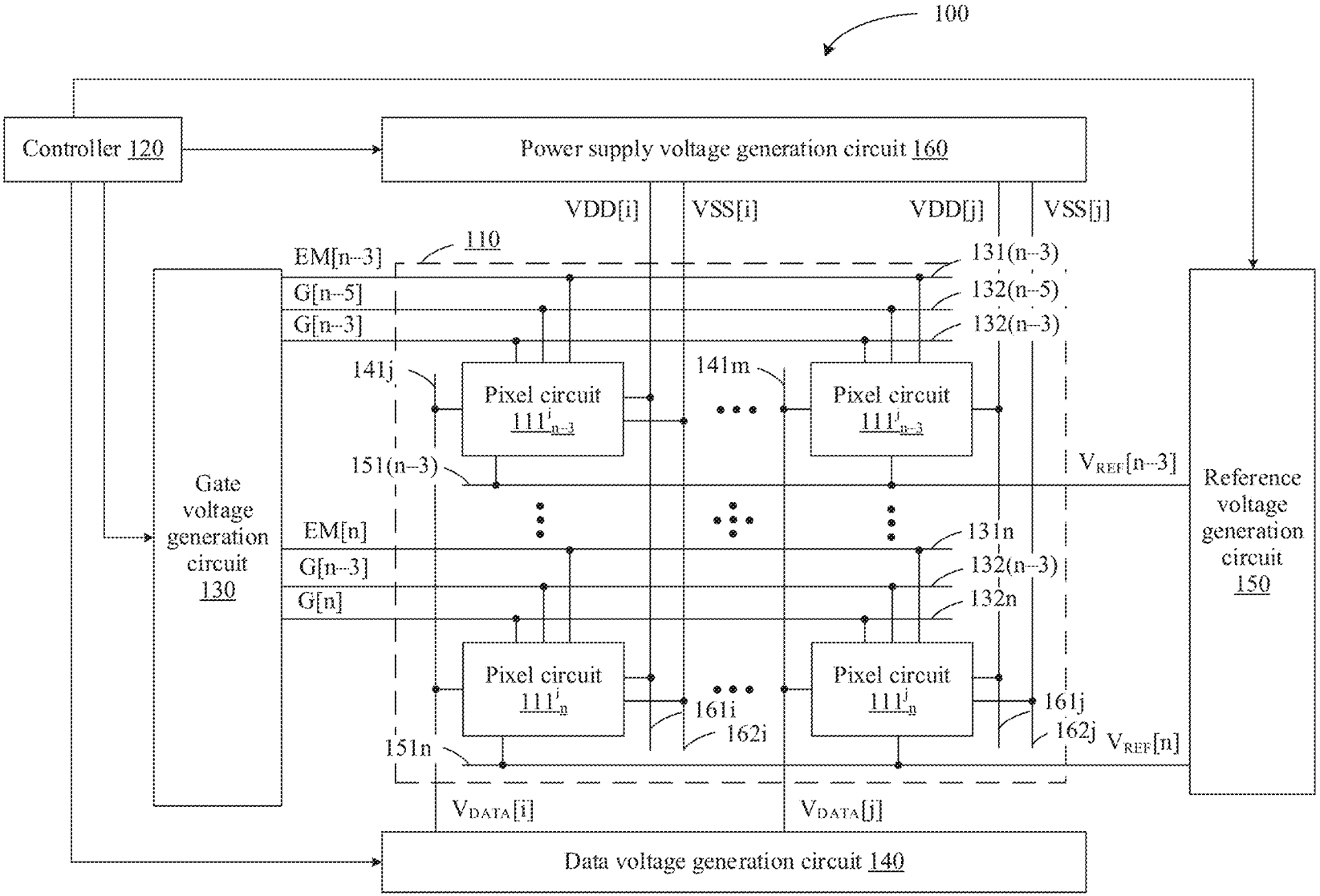
FIG. 1 is a schematic diagram of a structure of a display apparatus 100 according to an embodiment of this application.

FIG. 1 is a schematic diagram of a structure of a display apparatus 100 according to an embodiment of this application. The display apparatus 100 may display an image based on image data provided by an external component (for example, a video card) of the display apparatus 100. An example of the display apparatus 100 may include but is not limited to an OILED display, an active matrix organic light emitting diode (active matrix organic light emitting diode, AMOLED) display, and the like. The display apparatus 100 may be used in a portable or mobile device, a mobile phone, a personal digital assistant, a cellular phone, a handheld PC, a wearable device (such as a smartwatch or a smart band), a portable media player, a handheld device, a navigation device, a server, a network device, a graphics device, a video game device, a set-top box, a laptop device, a virtual reality and/or augmented reality device, an Internet-of-Things device, an industrial control device, an in-vehicle infotainment device, a streaming media client device, an ebook, a reading device, a POS terminal, and other devices.

As shown in FIG. 1, the display apparatus 100 may include a display panel 110, a controller 120, a gate voltage generation circuit 130, a data voltage generation circuit 140, a reference voltage generation circuit 150, and a power supply voltage generation circuit 160. One or more components (for example, one or more of the controller 120, the gate voltage generation circuit 130, the data voltage generation circuit 140, the reference voltage generation circuit 150, and the power supply voltage generation circuit 160) of the display apparatus 100 may be implemented by any one or any combination of hardware, software, and firmware, for example, by an application-specific integrated circuit (ASIC), an electronic circuit, a processor and/or a memory (shared, dedicated, or group) that executes one or more software or firmware programs, a combinational logic circuit, or any combination of other suitable components that provide the described function In addition, although a separate controller 120 is shown in FIG. 1, some or all of the functions of the controller 120 may alternatively be integrated into one or more of the gate voltage generation circuit 130, the data voltage generation circuit 140, the reference voltage generation circuit 150, and the power supply voltage generation circuit 160.

The display panel 110 may include a plurality of pixel circuits arranged in N rows and M columns (where N and M are positive integers). For clarity, only four pixel circuits $\mathbf{111}_{n-3}^{i}$, $\mathbf{111}_{n-3}^{j}$, $\mathbf{111}_{n}^{i}$ and $\mathbf{111}_{n}^{j}$ (collectively referred to as pixel circuits 111) are shown on the display panel 110 in FIG. 1, where 3<n<N, 1<i, j<M, and n, i, and j are all positive integers. The pixel circuit $\mathbf{111}_{n-3}^{i}$ represents the $i^{th}$ pixel circuit in the $(n-3)^{th}$ pixel circuit row, the pixel circuit $\mathbf{111}_{a-3}^{j}$, represents the $j^{th}$ pixel circuit in the $(n-3)^{th}$ pixel circuit row, the pixel circuit $\mathbf{111}_{a}^{i}$ represents the $i^{th}$ pixel circuit in the $n^{th}$ pixel circuit row, and the pixel circuit $\mathbf{111}_{n}^{j}$ represents the $j^{th}$ pixel circuit in the $n^{th}$ pixel circuit row. It should be noted that the display panel 110 may have any quantity of pixel circuit rows and pixel circuits 111, and which are not limited to those shown in FIG. 1. In addition, this embodiment of this application is also applicable to pixel circuit rows and pixel circuits 111 that are not shown in FIG. 1.

In addition, the display panel 110 may further include a light emitting control line 131(*n*−3) coupled to the pixel circuits $\mathbf{111}_{n-3}^{i}$, and $\mathbf{111}_{n-3}^{j}$, and a light emitting control line 131*n* coupled to the pixel circuits $\mathbf{111}_{n}^{j}$ and $\mathbf{111}_{n}^{j}$, where the light emitting control lines 131(*n*−3) and 131*n* may be collectively referred to as light emitting control lines 131, and are configured to provide the pixel circuits 111 with gate voltages EM generated by the gate voltage generation circuit 130; a scan line 132(*n*−5) coupled to the pixel circuits $\mathbf{111}_{n-3}^{i}$ and $\mathbf{111}^{n-3}{}_{j}$, a scan line 132*n* coupled to the pixel circuits $\mathbf{111}_{n}^{i}$ and $\mathbf{111}_{n}^{j}$, and a scan line 132(*n*−3) coupled to the pixel circuits $\mathbf{111}_{n-3}^{i}$, $\mathbf{111}_{n-3}^{j}$, $\mathbf{111}_{n}^{i}$ and $\mathbf{111}_{n}^{j}$, where the scan lines 132(*n*−5), 132(*n*−3), and 132*n* may be collectively referred to as scan lines 132, and are configured to provide the pixel circuits 111 with gate voltages G generated by the gate voltage generation circuit 130; a reference line 151 (*n*−3) coupled to the pixel circuits $\mathbf{111}_{n-3}^{i}$ and $\mathbf{111}_{n-3}^{j}$ and a reference line 151*n* coupled to the pixel circuit $\mathbf{111}_{a}^{i}$ and $\mathbf{111}_{n}^{j}$, where the reference lines 151(*n*−3) and 151*n* may be collectively referred to as reference lines 151, and are configured to provide the pixel circuits 111 with reference voltages $V_{REF}$ generated by the reference voltage generation circuit 150; a data line 141*i* coupled to the pixel circuits $\mathbf{111}_{n-3}^{i}$ and $\mathbf{111}_{n}^{i}$ and a data line 141*j* coupled to the pixel circuits $\mathbf{111}_{n-3}^{j}$ and $\mathbf{111}_{n}^{j}$, where the data signal lines 141*i* and 141*j* may be collectively referred to as data lines 141, and are configured to provide the pixel circuits 111 with data voltages $V_{DATA}$ generated by the data voltage generation circuit 140; and power lines 161*i* and 162*i* coupled to the pixel circuits $\mathbf{111}_{a-3}^{j}$ and $\mathbf{111}_{n}^{j}$ and power lines 161*j* and 162*j* coupled to the pixel circuits $\mathbf{111}_{n-3}^{j}$ and $\mathbf{111}_{n}^{j}$, where the power lines 161*i* and 161*j* may be collectively referred to as power lines 161, and are configured to provide the pixel circuits 111 with power supply voltages VDD generated by the power supply voltage generation circuit 160, and the power lines 162*i* and 162*j* may be collectively referred to as power lines 162, and configured to provide the pixel circuits 111 with power supply voltages VSS generated by the power supply voltage generation circuit 160.

According to some embodiments of this application, the controller 120 may send a control signal (for example, but not limited to a clock signal) to the gate voltage generation circuit 130, so that the gate voltage generation circuit 130 generates a plurality of gate voltages EM and gate voltages G based on the control signal. The controller 120 may further send to-be-displayed image data to the data voltage generation circuit 140, so that the data voltage generation circuit 140 generates a plurality of data voltages $V_{DATA}$ based on the image data. The controller 120 may further send a control signal to the reference voltage generation circuit 150 and the power supply voltage generation circuit 160, so that the reference voltage generation circuit 150 gvenerates the reference voltages $V_{REF}$, and the power supply voltage generation circuit 160 generates the power supply voltages VDD and VSS.

According to some embodiments of this application, the gate voltage generation circuit 130 may generate the gate voltage EM and the gate voltage G for each pixel circuit row based on the control signal sent by the controller 120. The two gate voltages may also be referred to as a light emitting control signal EM and a scan signal G. The gate voltage generation circuit 130 may further load the generated light emitting control signals EM row by row to the pixel circuits 111 through the light emitting control lines 131 and load the generated scan signals G row by row to the pixel circuits 111 through the scan signal lines 132. For example, the gate voltage generation circuit 130 may generate the gate voltages EM and the gate voltages G by using a shift register.

For example, as shown in FIG. 1, the gate voltage generation circuit 130 may generate a light emitting control signal EM[n−3] and a scan signal G[n−3] for the $(n-3)^{th}$ pixel circuit row, and loads the light emitting control signal EM[n−3] to a light emitting driving circuit in each pixel circuit 111 in the $(n-3)^{th}$ pixel circuit row through the light emitting control line 131 (*n*−3). The light emitting driving circuit is configured to enable a light emitting component (for example, but not limited to an OLED or an LED (light emitting diode, light emitting diode)) in the pixel circuit 111 to emit light of expected luminance. The gate voltage generation circuit 130 also loads the scan signal G[n−3] to a write circuit in each pixel circuit 111 of the $(n-3)^{th}$ pixel circuit row through the scan line 132(*n*−3). The write circuit is configured to adjust a voltage at one end of a storage capacitor in the pixel circuit 111 to V2 based on a data voltage $V_{DATA}$. In addition, the gate voltage generation circuit 130 also loads a scan signal G[n−5] generated for the $(n-5)^{th}$ pixel circuit row to a reset circuit in each pixel circuit 111 of the $(n-3)^{th}$ pixel circuit row through the scan line 132 (*n*−5). The reset circuit is configured to adjust the voltage at one end of the storage capacitor in the pixel circuit 111 to V1 based on a reference voltage $V_{REF}$. In one example, a moment at which the gate voltage generation circuit 130 loads the scan signal G[n−3] to the write circuit in each pixel circuit 111 of the $(n-3)^{th}$ pixel circuit row is the same as a moment at which the gate voltage generation circuit 130 loads the scan signal G[n−5] to the reset circuit in each pixel circuit 111 of the $(n-3)^{th}$ pixel circuit row.

For another example, as shown in FIG. 1, the gate voltage generation circuit 130 may generate a light emitting control signal EM[n] and a scan signal G[n] for the $n^{th}$ pixel circuit row; load the light emitting control signal EM[n] to a light emitting driving circuit in each pixel circuit 111 of the $n_{th}$ pixel circuit row through the light emitting control line 131*n*; and load the scan signal G[n] to a write circuit in each pixel circuit 111 of the $n^{th}$ pixel circuit row through the scan line 132*n*. In addition, the gate voltage generation circuit 130 also loads the scan signal G[n−3] generated for the $(n-3)^{th}$ pixel circuit row to a reset circuit in each pixel circuit 111 of the $n^{th}$ pixel circuit row through the scan line 132 (*n*−3). In one example, a moment at which the gate voltage generation circuit 130 loads the scan signal G[n] to the write circuit in each pixel circuit 111 of the $n^{th}$ pixel circuit row is the same as a moment at which the gate voltage generation circuit 130 loads the scan signal G[n−3] to the reset circuit in each pixel circuit 111 of the $n^{th}$ pixel circuit row.

It should be noted that, according to some other embodiments of this application, the gate voltage generation circuit 130 may alternatively be split into two gate voltage generation circuits, which are respectively used to generate the gate voltage EM and the gate voltage G.

According to some embodiments of this application, the data voltage generation circuit 140 may generate, for each pixel circuit 111 based on the image data sent by the controller 120, a data voltage $V_{DATA}$ used to control luminance of light emitted by the light emitting component. The data voltage $V_{DATA}$ may also be referred to as a data signal $V_{DATA}$. The data voltage generation circuit 140 may further load the generated data signal $V_{DATA}$ to each pixel circuit 111 through the data line 141.

For example, as shown in FIG. 1, the data voltage generation circuit 140 may generate a data signal $V_{DATA}$[i] for the pixel circuit $\mathbf{111}_{n-3}^{i}$ and load the data signal $V_{DATA}$[i] to a write circuit of the pixel circuit $\mathbf{111}_{n-3}^{i}$, through the data line 141*i*. It should be noted that, the data voltage generation circuit 140 may also generate a data signal $V_{DATA}$[i] for the pixel circuit $\mathbf{111}_{n}^{i}$, and load the data signal $V_{DATA}$[i] to a write circuit of the pixel circuit $\mathbf{111}_{n}^{i}$, through the data line 141*i*. The data signal $V_{DATA}$[i] of the pixel circuit $\mathbf{111}_{n-3}^{i}$ may be loaded when the gate voltage generation circuit 130 loads the scan signal G for the $(n-3)^{th}$ pixel circuit row, and the data signal $V_{DATA}$[i] of the pixel circuit $\mathbf{111}_{n}^{i}$, may be loaded when the gate voltage generation circuit 130 loads the scan signal G for the $n^{th}$ pixel circuit row In addition, the data signal $V_{DATA}$[i] of the pixel circuit $\mathbf{111}_{n-3}^{i}$ and the data signal $V_{DATA}$[i] of the pixel circuit $\mathbf{111}_{n}^{j}$ may have different values.

For another example, as shown in FIG. 1, the data voltage generation circuit 140 may generate a data signal $V_{DATA}$[j] for the pixel circuit $\mathbf{111}_{n-3}^{j}$, and load the data signal $V_{DATA}$[j] to a write circuit of the pixel circuit $\mathbf{111}_{n-3}^{j}$ through the data line 141*m*. It should be noted that, the data voltage generation circuit 140 may also generate a data signal $V_{DATA}$[j] for the pixel circuit $\mathbf{111}_{n}^{j}$, and load the data signal $V_{DATA}$[j] to a write circuit of the pixel circuit $\mathbf{111}_{n}^{j}$ through the data line 141*m* The data signal $V_{DATA}$[j] of the pixel circuit $\mathbf{111}_{n-3}^{j}$ may be loaded when the gate voltage generation circuit 130 loads the scan signal G for the $(n-3)^{th}$ pixel circuit row, and the data signal $V_{DATA}$[j] of the pixel circuit $\mathbf{111}_{n}^{j}$ may be loaded when the gate voltage generation circuit 130 loads the scan signal G for the $n^{th}$ pixel circuit row In addition, the data signal $V_{DATA}$[j] of the pixel circuit $\mathbf{111}_{n-3}^{j}$ and the data signal $V_{DATA}$[j] of the pixel circuit $\mathbf{111}_{n_hu\ j}$ may have different values.

According to some embodiments of this application, the reference voltage generation circuit 150 may generate a reference voltage $V_{REF}$ for each pixel circuit 111 based on the control signal sent by the controller 120. The reference voltage $V_{REF}$ may also be referred to as a reference signal $V_{REF}$. The reference voltage generation circuit 150 may further load the generated reference signal $V_{REF}$ to each pixel circuit 111 through the reference line 151.

In an example, each pixel circuit 111 has a same reference signal $V_{REF}$.

For example, as shown in FIG. 1, the reference voltage generation circuit 150 may generate reference signals $V_{REF}$[n−3] for the pixel circuits $\mathbf{111}_{n-3}^{i}$ and $\mathbf{111}_{n-3}^{j}$ and load the reference signals $V_{REF}$[n−3] to reset circuits of the pixel circuits $\mathbf{111}_{n-3}^{i}$ and $\mathbf{111}_{n-3}^{j}$ through the reference line 151 (*n*−3). The reference voltage generation circuit 150 may also generate a reference signal $V_{REF}$[n] for the pixel circuits $\mathbf{111}_{n}^{i}$ and $\mathbf{111}_{n}^{j}$ and load the reference signal $V_{REF}$[n] to reset circuits of the pixel circuits $\mathbf{111}_{n}^{i}$ and $\mathbf{111}_{n}^{j}$ through the reference line 151*n*.

According to some embodiments of this application, the power supply voltage generation circuit 160 may generate the power supply voltages VDD and VSS for each pixel circuit 111 based on the control signal sent by the controller 120. The power supply voltages VDD and VSS may also be referred to as power supply signals VDD and VSS. The power supply voltage generation circuit 160 may further load the power supply signals VDD and VSS to each pixel circuit 111 through the power line 161 and the power line 162.

In an example, each pixel circuit 111 has same power supply signals VDD and VSS.

For example, as shown in FIG. 1, the reference voltage generation circuit 150 may generate power supply signals VDD[i] and VSS[i] for the pixel circuits $\mathbf{111}_{n-3}^{i}$ and $\mathbf{111}_{n}^{i}$, load the power supply signal VDD[i] to light emitting driving circuits of the pixel circuits $\mathbf{111}_{n-3}^{i}$ and $\mathbf{111}_{n}^{i}$ through the power line 161*i*, and load the power supply signal VSS[i] to light emitting components of the pixel circuits $\mathbf{111}_{n-3}^{i}$ and $\mathbf{111}_{n}^{i}$ through the power line 162*i*. The reference voltage generation circuit 150 may also generate power supply signals VDD[j] and VSS[j] for the pixel circuits $\mathbf{111}_{n-3}^{j}$ and $\mathbf{111}_{n}^{j}$, load the power signal VDD[j] to light emitting driving circuits of the pixel circuits $\mathbf{111}_{n-3}^{j}$ and $\mathbf{111}_{n}^{j}$ through the power line 161*j*, and load the power signal VSS[j] to light emitting components of the pixel circuits $\mathbf{111}_{n-3}^{j}$ and $\mathbf{111}_{n}^{j}$ through the power line 162*j*.

Figure 2:
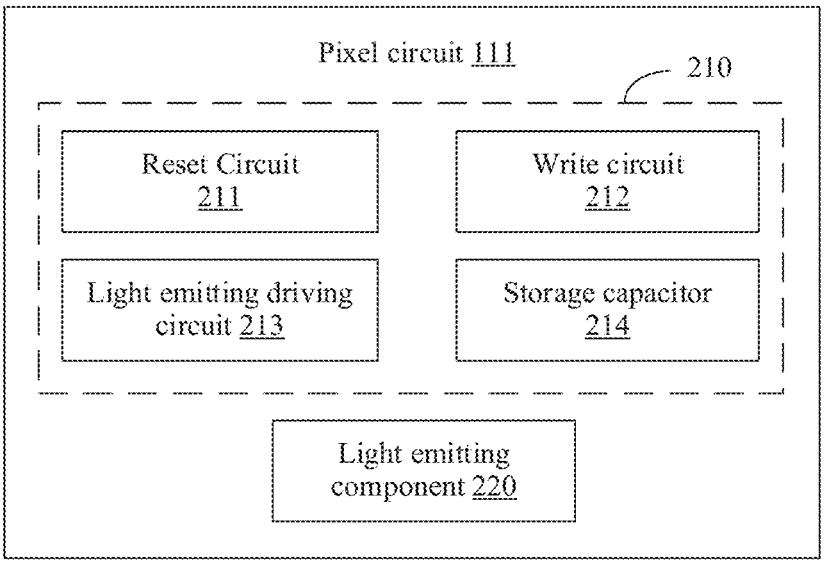
FIG. 2 is a schematic diagram of a module structure of a pixel circuit 111 according to an embodiment of this application.

FIG. 2 is a schematic diagram of a module structure of a pixel circuit 111 according to an embodiment of this application. As shown in the figure, the pixel circuit 111 includes a light emitting component driving circuit 210 and a light emitting component 220. The light emitting component driving circuit 210 may drive the light emitting component 220 to emit light of expected luminance, and one time of driving the light emitting component by the light emitting component driving circuit 210 may include a reset phase, a write phase, and a light emitting driving phase.

The light emitting component driving circuit 210 may further include a reset circuit 211, a write circuit 212, a light emitting driving circuit 213, and a storage capacitor 214. Each of the reset circuit 211, the write circuit 212, and the light emitting driving circuit 213 includes at least one transistor, for example, but not limited to a TFT transistor.

According to some embodiments of this application, in the reset phase, the reset circuit 211 may adjust a voltage at one end of the storage capacitor 214 to V1 based on a reference signal $V_{REF}$ under control of a scan signal G generated by the gate voltage generation circuit 130. For example, the scan signal G[−5] may control reset circuits 211 of the pixel circuits $\mathbf{111}_{n-3}^{i}$ and $\mathbf{111}_{n-3}^{j}$, and the scan signal G[n−3] may control reset circuits 211 of the pixel circuits $\mathbf{111}_{n-3}^{i}$ and $\mathbf{111}_{n}^{j}$.

According to some embodiments of this application, in the write phase, the write circuit 212 may adjust a voltage at one end of the storage capacitor 214 to V2 based on a data signal $V_{DATA}$ under control of a scan signal G generated by the gate voltage generation circuit 130. For example, the scan signal G[n−3] may control write circuits 212 of the pixel circuits $\mathbf{111}_{n-3}^{i}$, and $\mathbf{111}_{n-3}^{j}$ and the scan signal G[n] may control write circuits 212 of the pixel circuits $\mathbf{111}_{n}^{i}$ and $\mathbf{111}_{n}^{j}$.

According to some embodiments of this application, in the light emitting driving phase, the light emitting driving circuit 213 may enable, under control of a light emitting control signal EM generated by the gate voltage generation circuit 130, the light emitting component 220 to emit light of expected luminance. For example, the light emitting driving signal EM[n−3] may control light emitting driving circuits 213 of the pixel circuits $\mathbf{111}_{n}^{i}$ and $\mathbf{111}_{n}^{j}$, and the light emitting driving signal EM[n−3] may control light emitting driving circuits 213 of the pixel circuits $\mathbf{111}_{n}^{i}$ and $\mathbf{111}_{n}^{j}$.

According to some embodiments of this application, the storage capacitor 214 may store a voltage related to the reference signal $V_{REF}$ in the reset phase, and may also store a voltage related to the data signal $V_{DATA}$ in the write phase.

The following uses the pixel circuit $\mathbf{111}_{n}^{j}$ in FIG. 1 as an example to further describe the pixel circuit in embodiments of this application with reference to FIG. 3 to FIG. 6. It should be noted that, another pixel circuit in the display panel 110 is also applicable to the following embodiments, and details are not described herein again.

Figure 3:
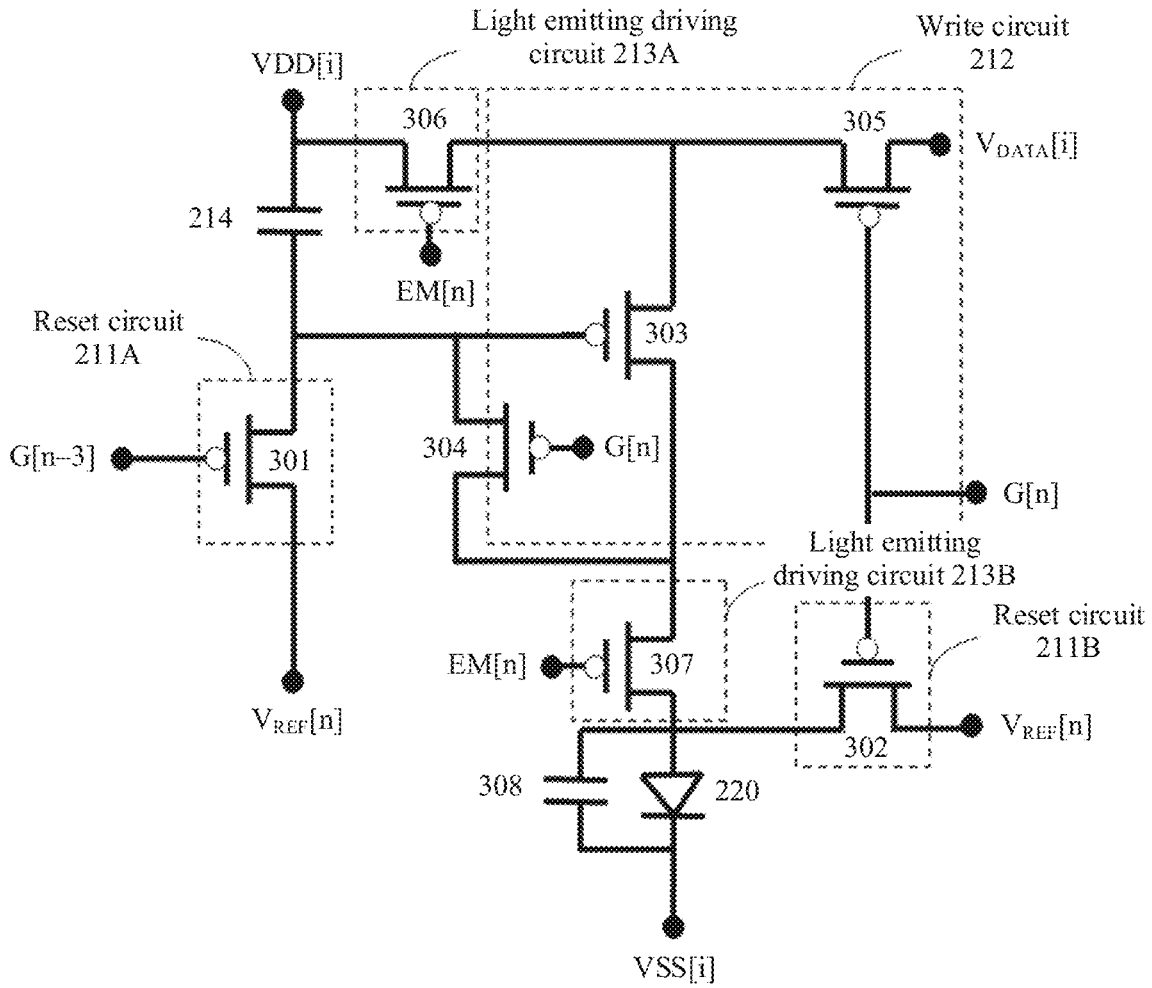
FIG. 3 is a schematic diagram of a circuit structure of a pixel circuit Iii according to an embodiment of this application.

FIG. 3 is a schematic diagram of a circuit structure of the pixel circuit $\mathbf{111}_{1}^{i}$ in FIG. 1 according to an embodiment of this application. As shown in FIG. 3, a pixel circuit 111*b* may include a storage capacitor 214, a light emitting component 220, p-type TFT transistors 301 to 307, and a light emitting component self-capacitor 308.

It should be noted that the transistors 301 to 307 may alternatively be n-type TFT transistors.

As shown in FIG. 3, reset circuits 211 in the pixel circuit $\mathbf{111}_{n}^{j}$ may include a reset circuit 211A and a reset circuit 211B. The reset circuit 211A includes the transistor 301. A gate electrode of the transistor 301 is coupled to the scan line 132 (*n*−3) (not shown in FIG. 3) to receive the scan signal G[n−3] of the $(n-3)^{th}$ pixel circuit row. A source electrode of the transistor 301 is coupled to the reference line 151*n* (not shown in FIG. 3) to receive the reference signal $V_{REF}$[n] (for example, but not limited to, −6 to −1.5 V). A drain electrode of the transistor 301 is coupled to one end of the storage capacitor 214, a gate electrode of the transistor 303, and a drain electrode of the transistor 304. The reset circuit 211B includes the transistor 302, A gate electrode of the transistor 302 is coupled to the scan line 132*n* (not shown in FIG. 3) to receive the scan signal G[n] of the $n^{th}$ pixel circuit row. A source electrode of the transistor 302 is coupled to the reference line 151*n* (not shown in FIG. 3) to receive the reference signal $V_{REF}$[n]. A drain electrode of the transistor 302 is coupled to one end of the light emitting component 220 and one end of the light emitting component self-capacitor 308.

The write circuit 212 of the pixel circuit $\mathbf{111}_n^j$ may include the transistors 303 to 305. The gate electrode of the transistor 303 is coupled to the drain electrode of the transistor 301, the drain electrode of the transistor 304, and one end of the storage capacitor 214. A source electrode of the transistor 303 is coupled to a drain electrode of the transistor 305 and a drain electrode of the transistor 306. A drain electrode of the transistor 303 is coupled to a source electrode of the transistor 304 and a source electrode of the transistor 307. A gate electrode of the transistor 304 is coupled to the scan line 132*n* (not shown in FIG. 3) to receive the scan signal G[n] of the $n^{th}$ pixel circuit row. The source electrode of the transistor 304 is coupled to the drain electrode of the transistor 303 and the source electrode of the transistor 307. The drain electrode of the transistor 304 is coupled to the gate electrode of the transistor 303, the drain electrode of the transistor 301, and one end of the storage capacitor 214. A gate electrode of the transistor 305 is coupled to the scan line 132*n* (not shown in FIG. 3) to receive the scan signal G[n] of the $n^{th}$ pixel circuit row A source electrode of the transistor 305 is coupled to the data line 141*i* (not shown in FIG. 3) to receive the data signal $V_{DATA}$[i] (for example, but not limited to, 2 V to 7 V). The drain electrode of the transistor 305 is coupled to the source electrode of the transistor 303 and the drain electrode of the transistor 306.

A light emitting driving circuit 213 of the pixel circuit $\mathbf{111}_n^i$ may include a light emitting driving circuit 213A and a light emitting driving circuit 213B. The light emitting driving circuit 213A includes the transistor 306. A gate electrode of the transistor 306 is coupled to the light emitting control line 131*n* (not shown in FIG. 3) to receive the light emitting control signal EM[n] of the $n^{th}$ t pixel circuit row. A source electrode of the transistor 306 is coupled to the power line 161*i* (not shown in FIG. 3) to receive a power source signal VDD[i] (for example, but not limited to, 4 to 5 V). The drain electrode of the transistor 306 is coupled to the source electrode of the transistor 303 and the drain electrode of the transistor 305. The light emitting driving circuit 213B includes the transistor 307. A gate electrode of the transistor 307 is coupled to the light emitting control line 131*n* (not shown in FIG. 3) to receive the light emitting control signal EM[n] of the $n^{th}$ pixel circuit row. The source electrode of the transistor 307 is coupled to the drain electrode of the transistor 303 and the source electrode of the transistor 304. The drain electrode of the transistor 307 is coupled to one end of the light emitting component, the drain electrode of the transistor 302, and one end of the light emitting component self-capacitor 308.

One end of the light emitting component 220 is coupled to one end of the light emitting component self-capacitor 308, the drain electrode of the transistor 307, and the drain electrode of the transistor 302, the other end of the light emitting component 220 is coupled to the other end of the light emitting component self-capacitor 308, and is also coupled to the power line 162*i* (not shown in FIG. 3) to receive the power signal VSS[i] (for example, but not limited to −4 V to −1 V).

Figure 4:
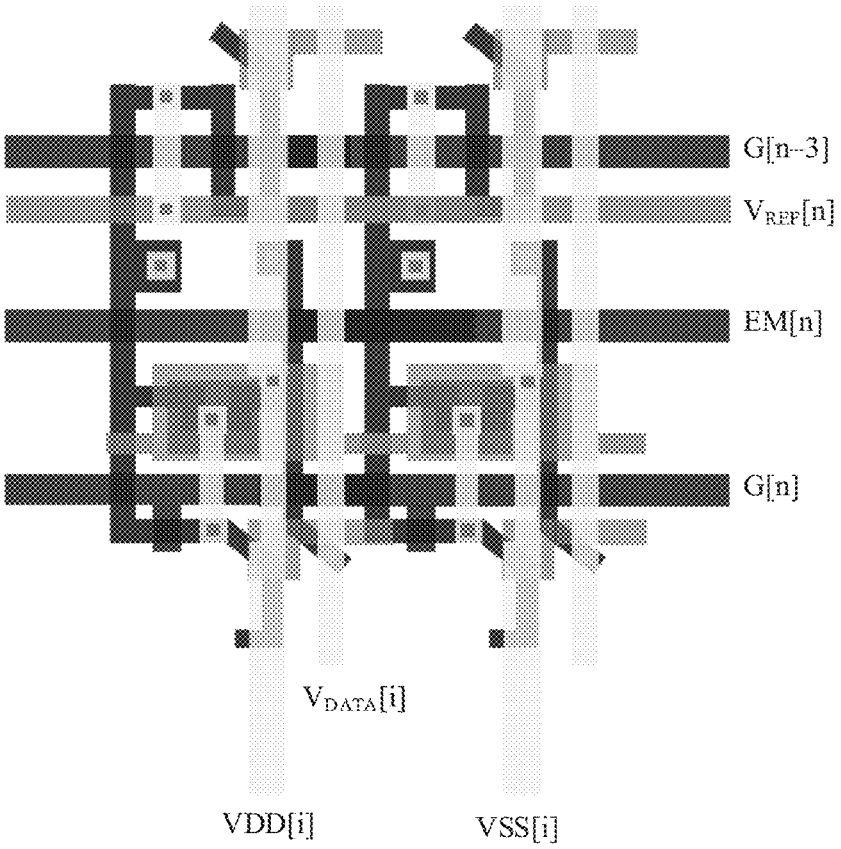
FIG. 4 is a schematic diagram of routing of a pixel circuit 111 according to an embodiment of this application.

FIG. 4 is a schematic diagram of routing of a pixel circuit according to an embodiment of this application by using the pixel circuit $\mathbf{111}_n^i$ as an example. As shown in FIG. 4, the pixel circuit $\mathbf{111}_n^i$ is controlled by the scan signal G[n−3], the reference signal $V_{RFF}$[n], the light emitting control signal EM[n], the scan signal G[n], the data signal $V_{Data}$[i], the power signal VDD[i] and the power signal VSS[i].

Figure 5:
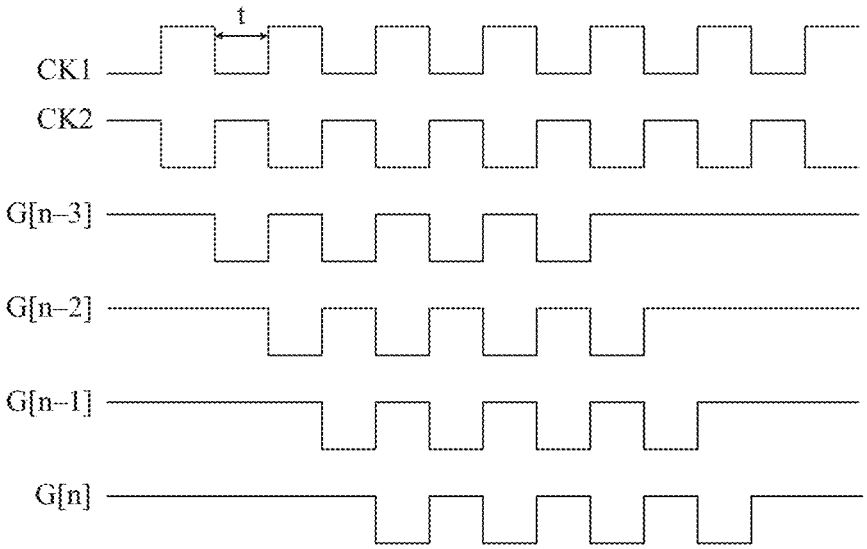
FIG. 5 is a schematic diagram of a time sequence of scan signals G generated by the gate voltage generation circuit 130 in FIG. 1 in a same scan cycle according, to an embodiment of this application.
Figure 6:
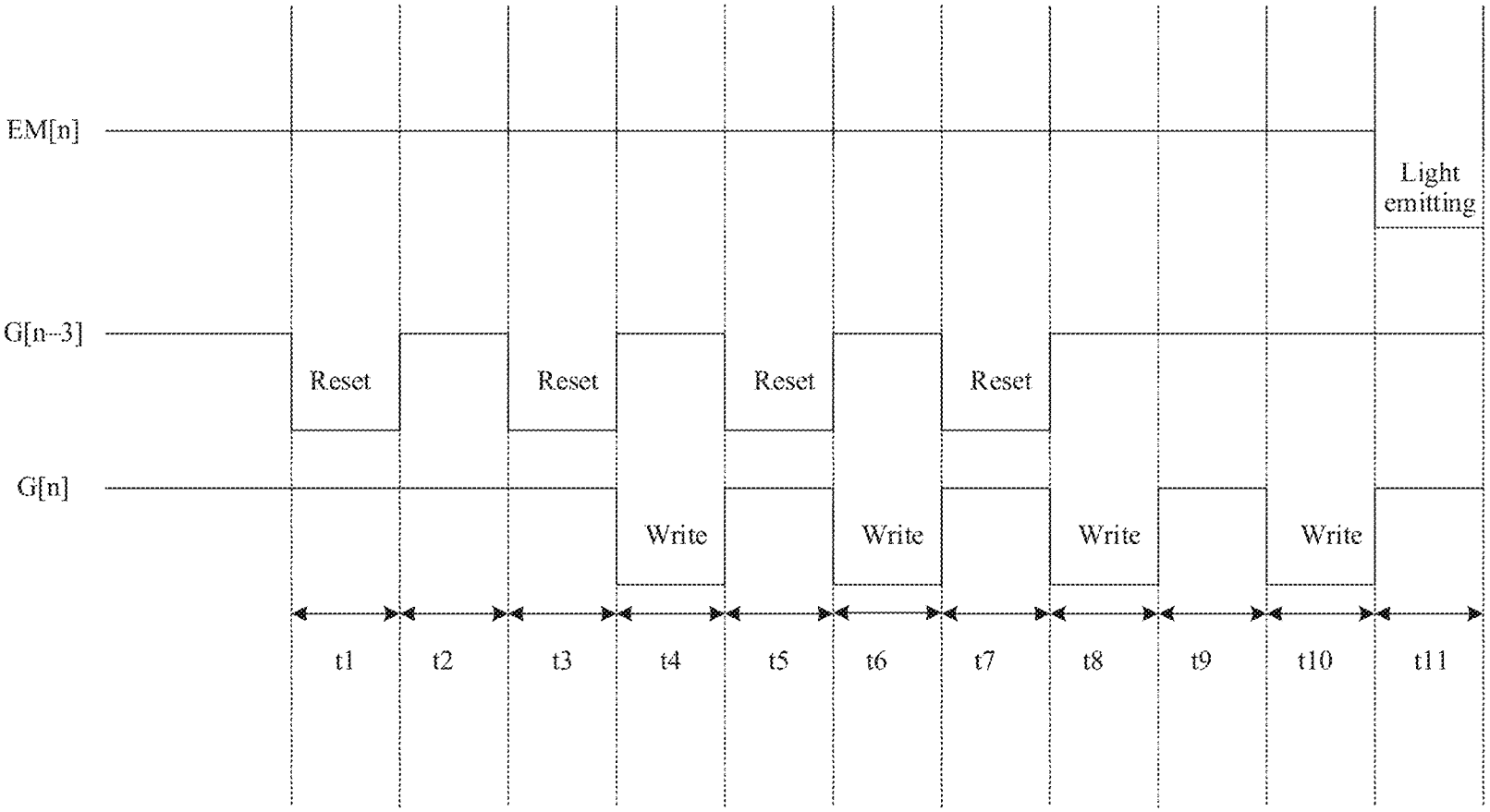
FIG. 6 is a schematic diagram of a time sequence of scan signals G[n−3] and G[n] and a light emitting control signal EM[n] that are loaded to the $n^{th}$ pixel circuit row in FIG. 1 in a same scan cycle according to an embodiment of this application.

With reference to FIG. 5 and FIG. 6, the following specifically describes how the light emitting component driving circuit 210 in the pixel circuit $\mathbf{111}_n^i$ drives the light emitting component 220 to emit light of expected luminance.

FIG. 5 is a schematic diagram of a time sequence of scan signals G generated by the gate voltage generation circuit 130 in FIG. 1 in a same scan cycle according to an embodiment of this application. CK1 and CK2 represent clock signals, and may include a plurality of clock cycles t. The gate voltage generation circuit 130 may generate, by using the shill register based on the clock signals CK1 and CK2, a scan signal G of each pixel circuit row, for example, the scan signal Q[n−3] of the $(n-3)^{th}$ pixel circuit row; a scan signal G[n−2] of the $(n-2)^{th}$ pixel circuit row; a scan signal G[n−1] of the (n−1) pixel circuit row, and the scan signal G[n] of the $n^{th}$ pixel circuit row.

In addition, the scan signal G of each pixel circuit row has a low electrical level (for example, but not limited to, −7 V to −8 V) in four clock cycles t, and there is a difference of one clock cycle between moments of initial low electrical levels of scan signals G of two adjacent pixel circuit rows. For example, as shown in FIG. 5, the scan signal G of each pixel circuit row has a low electrical level in four clock cycles t. An initial low electrical level of the scan signal G[n−3] is one dock cycle earlier than an initial low electrical level of the scan signal G[n−2], the initial low electrical level of the scan signal G[n−2] is one clock cycle earlier than an initial low electrical level of the scan signal G[n−1], and the initial low electrical level of the scan signal G[n−1] is one clock cycle earlier that an initial low electrical level of the scan signal G[n].

It should be noted that, when each transistor of the pixel circuit $\mathbf{111}_n^i$ is the n-type TFT transistor, the scan signal G of each pixel circuit row has a high electrical level (for example, hut not limited to, 7 V to 8 V) in four clock cycles t, and there is a difference of one clock cycle between moments of initial high electrical levels of scan signals G of two adjacent pixel circuit rows.

FIG. 6 is a schematic diagram of a time sequence of the scan signals G[n−3] and G[n] and the light emitting control signal EM[n] that control the pixel circuit $\mathbf{111}_n^i$ in FIG. 1 in a same scan cycle according to an embodiment of this application. Clock cycles t1 to t11 are the same as the clock cycle t in FIG. 5.

As shown in FIG. 6, in the clock cycle t1, the light emitting control signal EM[n] (for example, but not limited to, 7 V to 8 V) and the scan signal G[n] have high electrical levels. Gate-source voltages of the transistors 302 to 307 shown in FIG. 3 are greater than a threshold voltage (that is, a bias voltage that is between a gate electrode and a source electrode and that enables a transistor to be in a critical cut-off state or a critical conducting state), and the transistors 302 to 307 are in the cut-off state. The scan signal G[n−3] has a low electrical level. Agate-source voltage of the transistor 301 in the reset circuit 211A shown in FIG. 3 is $V_{GS}^{301}=G[n-3]-V_{REF}<V_{th}^{301}$, where $V_{th}^{301}$ is a threshold voltage of the transistor 301. The transistor 301 is in the conducting state. A voltage of the drain electrode of the transistor 301, one end of the storage capacitor 214, and the drain electrode of the transistor 303 that are coupled to each other is changed to $V1=V_{REF}-V_{SD}^{301}\approx V_{REF}$, where $V_{SD}^{301}$ is a voltage between the source electrode and the drain electrode of the transistor 301. The clock cycle t1 may also be referred to as the foregoing reset phase. The voltage at one end of the storage capacitor 214 is adjusted to be approximate to $V_{REF}$. This can eliminate impact generated on current driving by a voltage stored in the storage capacitor 214 in a write phase of previous driving.

In the clock cycle t2, the light emitting control signal EM[n], the scan signal G[n−3], and the scan signal G[n] all have high electrical levels. Gate-source voltages of the transistors 301 to 307 shown in FIG. 3 are greater than the threshold voltage. Therefore, the transistors are all in the cut-off state.

In the clock cycle t3, the light emitting control signal EM[n] and the scan signal G[n] have high electrical levels, and the scan signal G[n−3] has a low electrical level, which is the same as the clock cycle t1, and is not described herein again.

In the clock cycle t4, the light emitting control signal EM [n] and the scan signal G[n−3] have high electrical levels. Gate-source voltages (that is, a voltage between a gate electrode and a source electrode) of the transistors 301, 306, and 307 shown in FIG. 3 are greater than the threshold voltage, and the transistors 301, 306, and 307 are in the cut-off state. The scan signal G[n] has a low electrical level. A gate-source voltage of the transistor 305 in the write circuit 212 shown in FIG. 3 is $V_{GS}^{305}=G[n]-V_{DATA}<V_{th}^{305}$, where $V_{th}^{305}$ is a threshold voltage of the transistor 305. The transistor 305 is in the conducting state. A drain voltage of the transistor 305 is $V_{DATA}-V_{SD}^{305}\approx V_{DATA}$, where $V_{SD}^{305}$ is a voltage between the source electrode and the drain electrode of the transistor 305. A gate-source voltage of the transistor 303 in the write circuit 212 shown in FIG. 3 is $V_{GS}^{303}=V_1-V_{DATA}+V_{SD}^{305}<V_{th}^{303}$, where $V_{th}^{303}$ is a threshold voltage of the transistor 303. The transistor 303 is in the conducting state. A voltage of the drain electrode of the transistor 303$=V_{DATA}-V_{SD}^{305}-V_{SD}^{305}\approx V_{VATA}$, where $V_{SD}^{305}$ is a voltage between the source electrode and the drain electrode of the transistor 303. A gate-source voltage of the transistor 304 in the write circuit 212 shown in FIG. 3 is $V_{GS}^{304}=G[n]-V_{data}+V_{SD}^{305}+V_{SD}^{303}<V_{th}^{304}$, where $V_{th}^{304}$ is a threshold voltage of the transistor 304. The transistor 304 is in the conducting state. Therefore, a current flows from the source electrode of the transistor 305 to the storage capacitor 214 after passing through the drain electrode of the transistor 305, the source electrode of the transistor 303, the drain electrode of the transistor 303, the source electrode of the transistor 304, and the drain electrode of the transistor 304. A voltage at an end at which the storage capacitor 214 is coupled to the gate electrode of the transistor 303 increases continuously.

When the voltage at one end of the storage capacitor 214 is increased to $V2=V_{DATA}+V_{th}^{303}$, the gate-source voltage of the transistor 303 is $V_{GS}\approx V_{DATA}+V_{th}^{303}-V_{DATA}=V_{th}^{303}$, the transistor 303 is in the critical cut-off state, and the voltage at the one end of the storage capacitor 214 stops increasing. The clock cycle t4 may also be referred to as the foregoing write phase.

In addition, in the clock cycle t4, a gate-source voltage of the transistor 302 of the reset circuit 211B shown in FIG. 3 is $V_{GS}^{302}=G[n]-V_{REF}<V_{th}^{301}$ where $V_{th}^{301}$ is a threshold voltage of the transistor 302. The transistor 302 is in the conducting state. A voltage of one end of the light emitting component 220 and one end of the light emitting component self-capacitor 308 that are coupled to each other is changed to $V_{REF}-V_{SD}^{302}\approx V_{REF}$, where $V_{SD}^{302}$ is a voltage between the source electrode and the drain electrode of the transistor 302. Because $V_{REF}$ is greater than or equal to $V_{SS}$, a case in which the light emitting component self-capacitor 308 discharges and the light emitting component 220 is forward conducted does not exist. This ensures that the light emitting component 220 is in an all-black state before the light emitting driving phase.

In the clock cycle t5, the light emitting control signal EM[n] and the scan signal G[n] have high electrical levels, and the scan signal G[n−3] has a low electrical level, which is the same as the clock cycle t1, and is not described herein again.

In the clock cycle t6, the light emitting control signal EM[n] and the scan signal G[n−3] have high electrical levels, and the scan signal G[n] has a low electrical level, which is the same as the clock cycle t4, and is not described herein again.

In the clock cycle t7, the light emitting control signal EM[n] and the scan signal G[n] have high electrical levels, and the scan signal G[n−3] has a low electrical level, which is the same as the clock cycle t1, and is not described herein again. In this way, after four reset phases, the voltage at the end at which the storage capacitor 214 is coupled to the drain electrode of the transistor 301 is repeatedly adjusted, so that a short-term residual image problem caused by a hysteresis effect of the transistor can be alleviated.

In the clock cycle t8, the light emitting control signal EM[n] and the scan signal G[n−3] have high electrical levels, and the scan signal G[n] has a low electrical level, which is the same as the clock cycle t4, and is not described herein again.

In the clock cycle t9, the light emitting control signal EM[n], the scan signal G[n−3], and the scan signal G[n] all have high electrical levels, which is the same as the clock cycle t2, and is not described herein again.

In the clock cycle t10, the light emitting control signal EM[n] and the scan signal G[n−3] have high electrical levels, and the scan signal G[n] has a low electrical level, which is the same as the clock cycle t4, and is not described herein again.

In the clock cycle t11, the scan signal G[n−3] and the scan signal G[n] have high electrical levels. Gate-source voltages of the transistors 301, 302, 304, and 305 shown in FIG. 3 are greater than the threshold voltage, and the transistors 301, 302, 304, and 305 are in the cut-off state. The light emitting control signal EM[n] has a low electrical level (for example, but not limited to, −7 to −8 V), A gate-source voltage of the transistor 306 in the light emitting driving circuit 213A shown in FIG. 3 is $V_{gs}^{306}=EM[n]-VDD[i]<V_{th}^{306}$, where $V_{th}^{306}$ is a threshold voltage of the transistor 306. The transistor 306 is in the conducting state. A drain voltage of the transistor 306 is $VDD[i]-V_{SD}^{306}\approx VDD[i]$, where $V_{SD}^{306}$ is a voltage between the source electrode and the drain electrode of the transistor 306. A gate-source voltage of the transistor 303 shown in FIG. 3 is $V_{GS}^{303}=V_{DATA}V_{th}^{303}-VDD[i]+V_{SD}^{306}<V_{gs\ (th)}$. The transistor 303 is in the conducting state. A drain voltage of the transistor 303 is $VDD[i]-V_{SD}^{306}-V_{SD}^{303}\approx VDD[i]$. A gate-source voltage of the transistor 307 in the light emitting driving circuit 213B shown in FIG. 3 is $V_{GS}^{307}\approx EM[n]-VDD[i]<V_{th}^{307}$, where $V_{th}^{307}$ is a threshold voltage of the transistor 307. The transistor 307 is in the conducting state. Therefore, a current flows from the source electrode of the transistor 306 to the light emitting component 220 after passing through the drain electrode of the transistor 306, the source electrode of the transistor 303, the drain electrode of the transistor 303, the source electrode of the transistor 307, and the drain electrode of the transistor 307, so that the light emitting component 220 is forward conducted and emits light. The clock cycle t11 may also be referred to as the foregoing light emitting driving phase.

In addition, because the transistor 303 works in a saturation region, and the transistors 306 and 307 work in a linear region, a current that flows to the light emitting component 220 is mainly determined based on a current $I_{DS}$ between the source electrode and the drain electrode of the transistor 303, and the current $I_{DS}$ may be determined based on the following expression:

$$I_{DS} = \frac{K}{2}(V_{GS}^{303} - V_{th}^{303})^2 \approx \frac{K}{2}(V_{DATA} + V_{th}^{303} - VDD[i] - V_{th}^{303})^2 = \frac{K}{2}(V_{DATA} - VDD[i])^2 \quad \text{Formula 1}$$

It can be learned from the formula 1 that, the current $I_{DS}$ used to control display luminance of the light emitting component 220 is irrelevant to the threshold voltage of the transistor 303 (that is, the bias voltage that is between the gate electrode and the source electrode and that enables the transistor 303 to be in the critical cut-off state or the critical conducting state). Therefore, a display luminance mura phenomenon caused by different threshold voltages of transistors of different driving circuits can be eliminated.

It can be learned from FIG. 6 that, because the initial low electrical level of the scan signal G[n−3] of the $(n-3)^{th}$ pixel circuit row is two clock cycles earlier than the initial low electrical level of the scan signal G[n] of the $n^{th}$ pixel circuit row, after the reset phase of the clock cycle t7, there are two write phases: the clock cycle t8 and the clock cycle t10. Because there is no reset phase after the two write phases, the two write phases are valid write phases. Therefore, when a write phase is relatively short due to a relatively high scanning frequency, two valid write phases can ensure that a voltage of an end at which the storage capacitor 214 is coupled to the drain electrode of the transistor 301 is adjusted to $V2=V_{DATA}+V_{th}^{303}$, so that the impact of the threshold voltage of the transistor is eliminated in the light emitting driving phase.

It should be noted that, although the foregoing embodiments show that the scan signal G of each pixel circuit row has a low electrical level (for example, but not limited to −7 V) in four clock cycles t, the scan signal G of each pixel circuit row may alternatively have low electrical levels in another quantity of clock cycles, for example, but not limited to two, three, or five.

It should be noted that, in the foregoing embodiment, for the pixel circuit $\mathbf{111}_n^i$, the gate voltage generation circuit 130 loads the scan signal G[n−3] of the (n−3) pixel circuit row to control the reset circuit 211 in the pixel circuit $\mathbf{111}_n^i$, and loads the scan signal G[n] of the $n^{th}$ pixel circuit row to control the write circuit 212 of the pixel circuit $\mathbf{111}_n^j$. However, the gate voltage generation circuit 130 may alternatively load a scan signal G of another pixel circuit row to control the reset circuit 211 in the pixel circuit $\mathbf{111}_n^i$. In a same scan cycle, a row scan time of the another pixel circuit row (that is, time elapsed since the gate voltage generation circuit. 130 starts to load the scan signal G for the pixel circuit row until the gate voltage generation circuit 130 stops loading the scan signal G) is earlier than a row scan time of the $n^{th}$ pixel circuit row by an odd multiple (greater than 1) of a clock cycle. That is, a difference between a row number of the $n^{th}$ pixel circuit row and a row number of the another pixel circuit row is an odd number greater than 1. For example, the gate voltage generation circuit 130 may alternatively load the scan signal G[n−5] of the $(n-5)^{th}$ pixel circuit row to control the reset circuit 211 in the pixel circuit $\mathbf{111}_n^j$. In this case, there are three valid write phases. The gate voltage generation circuit 130 may alternatively load a scan signal G[n−7] of the $(n-7)^{th}$ pixel circuit row to control the reset circuit 211 of the pixel circuit $\mathbf{111}_n^j$. In this case, there are four valid write phases.

In other words, in the row scan time, a moment of an initial low electrical level (or an initial high electrical level) of the scan signal G that controls the reset circuit 211 of the pixel circuit $\mathbf{111}_n^i$ is earlier than a moment of an initial low electrical level (or an initial high electrical level) of the scan signal G[n] by an odd multiple (for example, but not limited to, greater than 1) of a clock cycle.

In this embodiment of this application, a scan signal of a pixel circuit row and a scan signal of another pixel circuit row are loaded to the pixel circuit row by using the gate voltage generation circuit. A row scan time of the pixel circuit row is earlier than a row scan time of the another pixel circuit row by an odd multiple (greater than or equal to 3) of a clock cycle, so that a quantity of valid write phases can be increased for a pixel circuit of the pixel circuit row. This can ensure that before the light emitting driving phase, a voltage at one end of a storage capacitor in the pixel circuit is adjusted to $V2=V_{DATA}+V_{th}^{303}$, so that by using $V2-VDD[i]-V_{th}^{303}$ in the light emitting driving phase, a display luminance mura phenomenon caused by different threshold voltages of transistors in different driving circuits can be eliminated.

Further, when the light emitting component is driven, a short-term residual image problem caused by a hysteresis effect of a transistor can be alleviated by increasing a quantity of reset phases.

Figure 7:
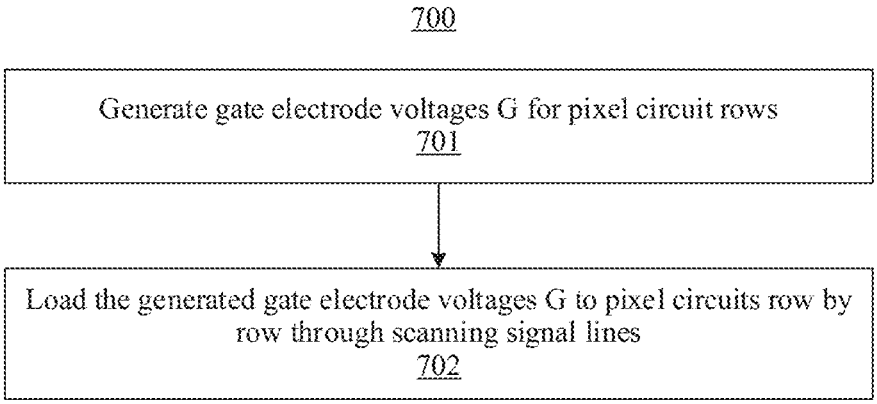
FIG. 7 is a schematic flowchart of a method 700 for controlling the display apparatus 100 in FIG. 1 according to an embodiment of this application.

FIG. 7 is a schematic flowchart of a method 700 for controlling the display apparatus 100 according to an embodiment of this application. In the gate voltage generation circuit 130 or another component of the display apparatus 100 shown in FIG. 1 may implement different blocks or other parts of the method 700. For content that is not described in the foregoing apparatus embodiment, refer to the following method embodiment. Similarly, for content that is not described in the method embodiment, refer to the foregoing apparatus embodiment. As shown in FIG. 7, the method for controlling the display apparatus 100 may include the following blocks.

Block 701: The gate voltage generation circuit 130 or another module, for example, but not limited to, a shift register generates gate electrode voltages G tier pixel circuit rows. The gate electrode voltage G may also be referred to as a scan signal G.

Block 702: The gate voltage generation circuit 130 or the another module loads the generated scan signals G row by row to the pixel circuits 111 through the scan signal lines 132.

For example, as shown in FIG. 1, the gate voltage generation circuit 130 may generate the scan signal G[n−3] for the (n−3) pixel circuit row and load the scan signal G[n−3] through the scan line 132 (n−3) to the write circuit in each pixel circuit 111 of the $(n-3)^{th}$ pixel circuit row. The write circuit is configured to adjust the voltage at one end of the storage capacitor in the pixel circuit 111 to V2 based on the data voltage $V_{DATA}$. In addition, the gate voltage generation circuit 130 loads the scan signal G[n−5] generated for the $(n-5)^{th}$ pixel circuit row to the reset circuit in each pixel circuit 111 of the $(n-3)^{h}$ pixel circuit row through the scan line 132 (n−5). The reset circuit is configured to reset the voltage at one end of the storage capacitor in the pixel circuit 111 to V1 based on the reference voltage $T_{REF}$.

For another example, as shown in FIG. 1, the gate voltage generation circuit 130 may generate the scan signal G[n] for the $n^{th}$ pixel circuit row; and load the scan signal G[n] to the write circuit in each pixel circuit 111 of the $n^{th}$ pixel circuit row through the scan line 132*n*. In addition, the gate voltage generation circuit 130 also loads the scan signal G[n−3] generated for the $(n-3)^{th}$ pixel circuit row to the reset circuit in each pixel circuit 111 of the $n_{th}$ pixel circuit row through the scan line 132 (*n*−3).

It should be noted that, for the $n^{th}$ pixel circuit row, the gate voltage generation circuit 130 may alternatively load a scan signal G of another pixel circuit row to control the reset circuit 211 in each pixel circuit 111 of the $n^{th}$ pixel circuit row. In a same scan cycle, a row scan time of the another pixel circuit row (that is, time elapsed since the gate voltage generation circuit 130 starts to load the scan signal G for the pixel circuit row until the gate voltage generation circuit 130 stops loading the scan signal G) is earlier than a row scan time of the $n^{th}$ pixel circuit row by an odd multiple (greater than 1) of a clock cycle. That is, a difference between a row number of the $n^{th}$ pixel circuit row and a row number of the another pixel circuit row is an odd number greater than 1. For example, the gate voltage generation circuit 130 may alternatively load the scan signal G[n−5] of the $(n-5)^{t}$ pixel circuit row, to control the reset circuit 211 in each pixel circuit 111 of the $n^{th}$ pixel circuit row or load the scan signal G[n−7] of the $(n-7)^{th}$ pixel circuit row, to control the reset circuit 211 in each pixel circuit 111 of the $n^{th}$ pixel circuit row.

In this embodiment of this application, a scan signal of a pixel circuit row and a scan signal of another pixel circuit row are loaded to the pixel circuit row by using the gate voltage generation circuit. A row scan time of the pixel circuit row is earlier than a row scan time of the another pixel circuit row by an odd multiple (greater than or equal to 3) of a clock cycle, so that a quantity of valid write phases can be increased for a pixel circuit of the pixel circuit row. This can ensure that before the light emitting driving phase, a voltage at one end of a storage capacitor in the pixel circuit is adjusted to $V2=V_{DATA}+V_{th}^{303}$, so that by using V2−VDD [i]$-V_{th}^{303}$ in the light emitting driving phase, a display luminance mum phenomenon caused by different threshold voltages of transistors in different driving circuits can be eliminated.

Figure 8:
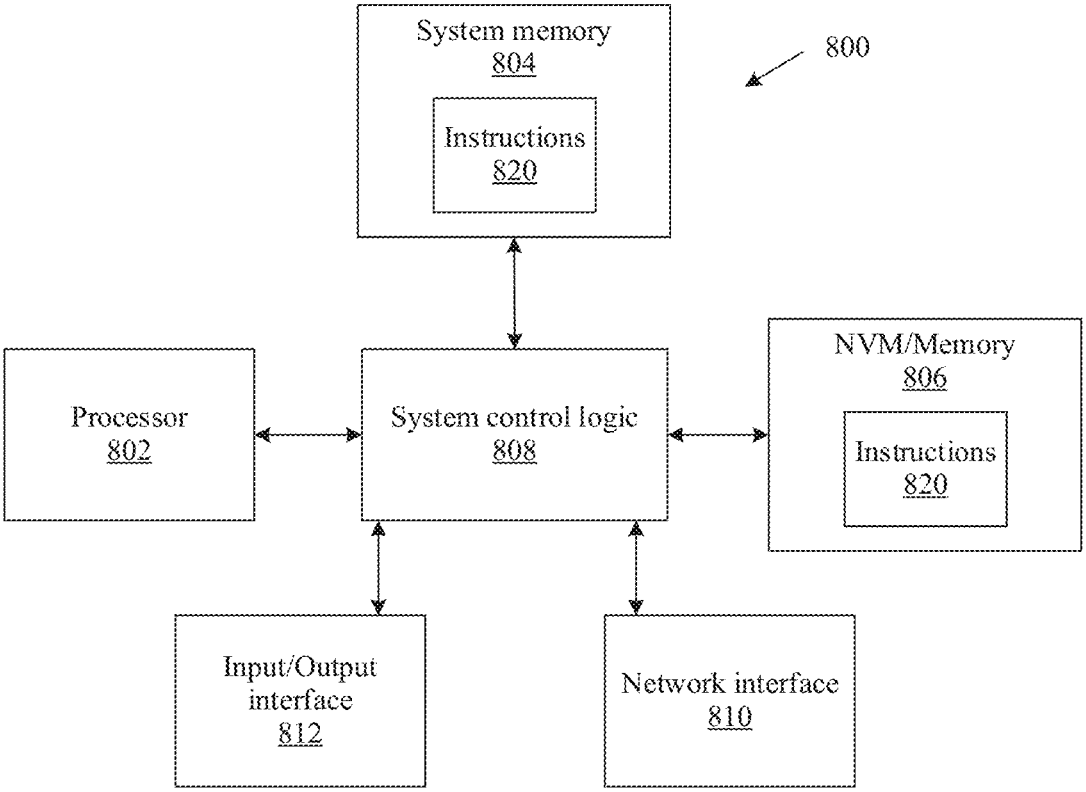
FIG. 8 is a schematic diagram of a structure of a system 800 according to an embodiment of this application.

FIG. 8 is a schematic diagram of a structure of an example system 800 according to an embodiment of this application. The system 800 may include one or more processors 802, a system control logic 808 connected to a plurality of the processors 802, a system memory 804 connected to the system control logic 808, a nonvolatile memory (NVM) 806 connected to the system control logic 808, and a network interface 810 connected to the system control logic 808.

The processor 802 may include one or more single-core or multi-core processors. The processor 802 may include any combination of a general-purpose processor and a special-purpose processor (for example, a graphics processor, an application processor, or a baseband processor). In this embodiment of this application, the processor 802 may be configured to perform the method embodiment described with reference to FIG. 6.

In some embodiments, the system control logic 808 may include any proper interface controller, to provide any proper interface for the plurality of the processors 802 and/or any proper device or component that communicates with the system control logic 808.

In some embodiments, the system control logic 808 may include one or more memory controllers, to provide an interface that connects to the system memory 804. The system memory 804 may be configured to load and store data and/or instructions used for the system 800. In some embodiments, the memory 804 in the system 800 may include any proper volatile memory, for example, a proper dynamic random access memory (DRAM).

The NVM/memory 806 may include one or more tangible, non-transitory computer-readable media that are configured to store data and/or instructions. In some embodiments, the NVM/memory 806 may include any proper nonvolatile memory such as a flash memory and/or any proper nonvolatile storage device such as a plurality of an HDI) (Hard Disk Drive, hard disk drive), a CD (Compact Disc, compact disc) drive, and a DVD (Digital Versatile Disc, digital versatile disc) drive.

The NVM/memory 806 may include a part of storage resources installed on apparatuses of the system 800, or may be accessed by a device, but is not necessarily a part of the device. For example, the NVM/memory 806 may be accessed over a network through the network interface 810.

In particular, the system memory 804 and the NVM/memor) 806 may respectively include a temporary copy and a permanent copy of instructions 820. The instructions 820 may include an instruction that, when being executed by at least one of the processors 802, the system 800 is enabled to implement the method embodiment described with reference to FIG. 6. In some embodiments, the instructions 820, hardware, firmware, and/or software components thereof may be additionally/alternatively placed in the system control logic 808, the network interface 810, and/or the processor 802.

The network interface 810 may include a transceiver. The transceiver is configured to provide a radio interface for the system 800 to communicate with any other proper device (for example, a front-end module or an antenna) over one or more networks. In some embodiments, the network interface 810 may be integrated into another component in the system 800. For example, the network interface 810 may include at least one of a processor 802, a system memo 804, an NVM/inemory 806, and a firmware device (not shown) that has instructions. When at least one processor 802 executes the instructions, the system 800 implements the method embodiment described in FIG. 6.

The network interface 810 may further include any proper hardware and/or firmware, to provide a multiple-input multiple-output radio interface. For example, the network interface 810 may be a network adapter, a wireless network adapter, a phone modem, and/or a wireless modem.

In an embodiment, a plurality of the processors 802 may be packaged with logics of one or more controllers used for the system control logic 808, to form a system in package (SiP), In an embodiment, the plurality of the processors 802 may be integrated on a same tube core with logics of one or more controllers used for the system control logic 808, to form a system on a chip (SoC).

The system 800 may further include an input/output (I/O) interface 812. The I/O interface 812 may include a user interface, so that a user can interact with the system 800, A design of a peripheral component interface also enables a peripheral component to interact with the system 800. In some embodiments, the system 800 further includes a sensor, configured to determine at least one of an environmental condition and location information that are associated with the system 800.

In some embodiments, the user interface may include but is not limited to a display (for example, a liquid crystal display or a touchscreen display), a speaker, a microphone, one or more cameras (for example, a still image camera and;

or a video camera), a flashlight (for example, a light-emitting diode flashlight), and a keyboard.

In some embodiments, the peripheral component interface may include but is not limited to a nonvolatile memory port, an audio jack, and a charging port.

In some embodiments, the sensor may include but is not limited to a gyro sensor, an accelerometer, a proximity sensor, an ambient light sensor, and a positioning unit. The positioning unit may alternatively be a part of the network interface 810, or may interact with the network interface 810, to communicate with a component (for example, a global positioning system (GPS) satellite) of a positioning network.

Although this application is described with reference to example embodiments, this does not mean that features of the present invention are limited to the implementations. On the contrary, a purpose of describing the present invention with reference to the implementations is to cover other selections or modifications that may be derived based on the claims of this application. To provide an in-depth understanding of this application, the following descriptions include a plurality of specific details. This application may be alternatively implemented without using these details. In addition, to avoid confusion or blurring the focus of this application, some specific details will be omitted from the description. It should be noted that embodiments in this application and the features in embodiments may be mutually combined in the case of no conflict.

Furthermore, various operations will be described as a plurality of discrete operations in a manner that is most conducive to understanding illustrative embodiments. However, an order described should not be construed as implying that these operations need to depend on the order. In particular, these operations do not need to be performed in the rendered order.

As used herein, a term "module" or "unit" may mean, be, or include: an application-specific integrated circuit (ASIC), an electronic circuit, a (shared, special-purpose, or group) processor and/or a memory that executes one or more software or firmware programs, a composite logic circuit, and/or another proper component that provides the described functions.

In the accompanying drawings, some structure or method features may be shown in a particular arrangement and/or order. However, it should be understood that such a particular arrangement and/or order may not be required. In some embodiments, these features may be arranged in a manner and/or order different from that shown in the illustrative accompanying drawings. In addition, inclusion of the structure or method features in a particular figure does not imply that such features are required in all embodiments, and in some embodiments, these features may not be included or may be combined with other features.

Embodiments of a mechanism disclosed in this application may be implemented in hardware, software, firmware, or a combination of these implementations. Embodiments of this application may be implemented as a computer program or program code executed in a programmable system. The programmable system includes a plurality of processors, storage systems (including a volatile memory, a nonvolatile memory, and/or a storage element), a plurality of input devices, and a plurality of output devices.

The program code may be configured to input instructions, to perform functions described in this application and generate output information. The output information may be applied to one or more output devices in a known manner. For a purpose of this application, a processing system includes any system having a processor such as a digital signal processor (DSP), a microcontroller, an application-specific integrated circuit (ASIC), or a microprocessor.

The program code may be implemented by using a high-level programming language or an object oriented programming language, to communicate with the processing system. The program code may alternatively be implemented by using an assembly language or a machine language when needed. Actually, the mechanism described in this application is not limited to a scope of any particular programming language. In any case, the language may be a compiled language or an interpretive language.

In some cases, the disclosed embodiments may be implemented by hardware, firmware, software, or any combination thereof. In some cases, one or more aspects of at least some embodiments may be implemented by expressive instructions stored in a computer-readable storage medium. The instructions represent various logics in a processor, and when the instructions are read by a machine, the machine is enabled to manufacture logics for performing the technologies described in this application. These representations referred to as "IP cores" may be stored in a tangible computer-readable storage median and provided for a plurality of customers or production facilities for loading into a manufacturing machine that actually manufactures the logic or the processor.

Such a computer-readable storage media may include but is not limited to non-transient tangible arrangements of articles manufactured or formed by machines or devices. The computer-readable storage media includes storage media, for example, a hard disk or any other type of disk including a floppy disk, a compact disc, a compact disc read-only memory (CD-ROM), a compact disc rewritable (CD-RW), or a magneto-optical disc; a semiconductor device, for example, a read-only memory (ROM) such as a random access memory (RAM) including a dynamic random access memory (DRAM) or a static random access memory (SRAM), an erasable programmable read-only memory (EPROM), a flash memory, or an electrically erasable programmable read-only memory (EEPROM); a phase change memory (PCM); a magnetic card or an optical card; or any other type of proper medium for storing electronic instructions.

Therefore, embodiments of this application further include a non-transient computer-readable storage medium. The medium includes instructions or design data, for example, a hardware description language (HDL), and defines a structure, a circuit, an apparatus, a processor, and/or a system feature described in this application.

What is claimed is:

1. A display apparatus, comprising:

pixel circuit rows comprising a first pixel circuit row and a second pixel circuit row, wherein each of the pixel circuit rows comprises pixel circuits, and wherein each of the pixel circuits comprises:

a light emitting component configured to emit light; and a driving circuit configured to drive the light emitting component and comprising:

a storage capacitor;

a write circuit configured to adjust, based on a data voltage, a first voltage at one end of the storage capacitor to a second voltage, wherein the data voltage controls luminance of the light; and a reset circuit configured to reset, based on a reference voltage, the second voltage to a third voltage; and a gate voltage generation circuit coupled to the pixel circuit rows and configured to:

generate a first scan signal to control first write circuits in the first pixel circuit row and control first reset circuits in the second pixel circuit row, wherein the first scan signal starts to be loaded by the first pixel circuit row at a first moment and starts to be loaded by the second pixel circuit row at a second moment; and generate a second scan signal to control second write circuits in the second pixel circuit row, wherein the second scan signal starts to be loaded by the second pixel circuit row at the second moment, wherein in a same frame scan cycle, the first moment is earlier than the second moment by a first odd multiple of a clock cycle, and wherein the first odd multiple is greater than or equal to 3.

2. The display apparatus of claim 1, wherein the second pixel circuit row is configured to load the first scan signal and the second scan signal in a time period, wherein in the time period, a third moment of a first initial low electrical level of the first scan signal is earlier than a fourth moment of a second initial low electrical level of the second scan signal by a second odd multiple of the clock cycle, and wherein the second odd multiple is greater than or equal to 3.

3. The display apparatus of claim 1, wherein the second pixel circuit row is configured to load the first scan signal and the second scan signal in a time period, wherein in the time period, a third moment of a first initial high electrical level of the first scan signal is earlier than a fourth moment of a second initial high electrical level of the second scan signal by a second odd multiple of the clock cycle, and wherein the second odd multiple is greater than or equal to 3.

4. The display apparatus according to claim 1, wherein the driving circuit comprises seven transistors and one storage capacitor.

5. The display apparatus according to claim 1, wherein the write circuit comprises:

a first transistor comprising:

a first source electrode, wherein a first source voltage of the first source electrode is controlled by the data voltage;

a first gate electrode, wherein a first gate voltage of the first gate electrode is controlled by the first scan signal or the second scan signal; and a first drain electrode;

a second transistor comprising:

a second source electrode coupled to the first drain electrode;

a second gate electrode coupled to the one end of the storage capacitor; and a second drain electrode; and a third transistor comprising:

a third source electrode coupled to the second drain electrode;

a third gate electrode, wherein a second gate voltage of the third gate electrode is controlled by the first scan signal or the second scan signal; and a third drain electrode coupled to the second gate electrode and the one end of the storage capacitor.

6. The display apparatus of claim 5, wherein the second voltage is equal to a sum of a threshold voltage of the second transistor and a difference between the data voltage and a fourth voltage between the first source electrode and the first drain electrode.

7. The display apparatus of claim 1, wherein the reset circuit comprises a transistor, and wherein the transistor comprises:

a gate electrode controlled by the first scan signal;

a source electrode controlled by the reference voltage; and a drain electrode coupled to the one end of the storage capacitor.

8. The display apparatus of claim 7, wherein the third voltage is equal to a difference between the reference voltage and a fourth voltage between the source electrode and the drain electrode.

9. The display apparatus of claim 1, wherein each light emitting component comprises:

at least one of an organic light-emitting diode (OLED) or a light-emitting diode (LED);

a self-capacitor connected in parallel with the at least one of the OLED or the and the LED.

10. A method for controlling a display apparatus, wherein the method comprises:

generating a first scan signal and a second scan signal;

loading the first scan signal to first write circuits in first driving circuits in a first pixel circuit row and to reset circuits in second driving circuits in a second pixel circuit row, wherein the first scan signal starts to be loaded to the first pixel circuit row at a first moment, and wherein the first scan signal starts to be loaded to the second pixel circuit row at a second moment;

loading the second scan signal to second write circuits in the second driving circuits, wherein the second scan signal starts to be loaded to the second pixel circuit row at the second moment;

adjusting, based on a data voltage, a first voltage at one end of a storage capacitor in each of the first driving circuits and the second driving circuits to a second voltage, wherein the data voltage controls luminance of light emitted by light emitting components in the first pixel circuit row and the second pixel circuit row; and resetting, based on a reference voltage, the first voltage to a third voltage, wherein in a same frame scan cycle, the first moment is earlier than the second moment by a first odd multiple of a clock cycle, and wherein the first odd multiple is greater than or equal to 3.

11. The method of claim 10, wherein loading the first scan signal to the reset circuits and loading the second scan signal to the second write circuits comprise loading the first scan signal to the reset circuits and loading the second scan signal to the second write circuits in a time period such that a third moment of a first initial low electrical level of the first scan signal is earlier than a fourth moment of a second initial low electrical level of the second scan signal by a second odd multiple of the clock cycle, and wherein the second odd multiple is greater than or equal to 3.

12. The method of claim 10, wherein loading the first scan signal to the reset circuits and loading the second scan signal to the second write circuits comprise loading the first scan signal to the reset circuits and loading the second scan signal to the second write circuits in a time period such that a third moment of a first initial high electrical level of the first scan signal is earlier than a fourth moment of a second initial high electrical level of the second scan signal by a second odd multiple of the clock cycle, and wherein the second odd multiple is greater than or equal to 3.

13. The method of claim 10, wherein each write circuit in the first write circuits and the second write circuits comprises a first transistor, a second transistor, and a third transistor, and wherein the method further comprises:

controlling a first gate voltage of the first transistor by using the first scan signal or the second scan signal;

controlling a source voltage of the first transistor by using the data voltage;

coupling a first source electrode of the second transistor to a drain electrode of the first transistor;

coupling a gate electrode of the second transistor to the one end of the storage capacitor in each write circuit;

controlling a second gate voltage of the third transistor by using the first scan signal or the second scan signal;

coupling a first drain electrode of the third transistor to the gate electrode and the one end of the storage capacitor in each write circuit; and coupling a second source electrode of the third transistor to a second drain electrode of the second transistor.

14. The method of claim 10, wherein each of the reset circuits comprises a transistor, and wherein the method comprises:

controlling a gate electrode of the transistor by using the first scan signal;

controlling a source electrode of the transistor by using the reference voltage; and coupling a drain voltage of the transistor to the one end of the storage capacitor in each write circuit.

15. The method of claim 14, wherein the second voltage is equal to a sum of a threshold voltage of the second transistor and a difference between the data voltage and a fourth voltage between the source electrode and the drain electrode.

16. The method of claim 14, wherein the second voltage is equal to a difference between the reference voltage and a third voltage between the source electrode and the drain electrode.

17. An electronic device, comprising:

a processor; and a display coupled to the processor and comprising:

pixel circuit rows comprising a first pixel circuit row and a second pixel circuit row, wherein each pixel circuit row comprises pixel circuits, and wherein each pixel circuit comprises:

a light emitting component configured to emit light; and a driving circuit configured to drive the light emitting component and comprising:

a storage capacitor;

a write circuit configured to adjust, based on a data voltage, a first voltage at one end of the storage capacitor to a second voltage, wherein the data voltage controls luminance of the light; and a reset circuit configured to reset, based on a reference voltage, the first voltage to a third voltage; and a gate voltage generation circuit coupled to the pixel circuit rows and configured to:

generate a first scan signal to control first write circuits in the first pixel circuit row and control first reset circuits in the second pixel circuit row, wherein the first scan signal starts to be loaded by the first pixel circuit row at a first moment and starts to be loaded by the second pixel circuit row at a second moment; and generate a second scan signal to control second write circuits in the second pixel circuit row, wherein the second scan signal starts to be loaded by the second pixel circuit row at the second moment, wherein in a same frame scan cycle, the first moment is earlier than the second moment by a first odd multiple of a clock cycle, and wherein the first odd multiple is greater than or equal to 3.

18. The electronic device of claim 17, wherein the second pixel circuit row is configured to load the first scan signal and the second scan signal in a time period, wherein in the time period, a third moment of a first initial low electrical level of the first scan signal is earlier than a fourth moment of a second initial low electrical level of the second scan signal by a second odd multiple of the clock cycle, and wherein the second odd multiple is greater than or equal to 3.

19. The electronic device of claim 17, wherein the second pixel circuit row is configured to load the first scan signal and the second scan signal in a time period, wherein in the time period, a third moment of a first initial high electrical level of the first scan signal is earlier than a fourth moment of a second initial high electrical level of the second scan signal by a second odd multiple of the clock cycle, and wherein the second odd multiple is greater than or equal to 3.

20. The electronic device of claim 17, wherein each driving circuit comprises seven transistors and one storage capacitor.

* * * * *